US011497264B2

(12) United States Patent
Maier

(10) Patent No.: US 11,497,264 B2
(45) Date of Patent: Nov. 15, 2022

(54) SEAT PAD FOR A CYCLIST GARMENT

(71) Applicant: ASSOS OF SWITZERLAND GMBH, San Pietro di Stabio (CH)

(72) Inventor: Roger Maier, Carona (CH)

(73) Assignee: ASSOS OF SWITZERLAND GMBH, San Pietro di Stabio (CH)

( * ) Notice: Subject to any disclaimer, the term of this patent is extended or adjusted under 35 U.S.C. 154(b) by 158 days.

(21) Appl. No.: 16/815,919

(22) Filed: Mar. 11, 2020

(65) Prior Publication Data

US 2020/0329796 A1 Oct. 22, 2020

(30) Foreign Application Priority Data

Apr. 19, 2019 (EP) ..... 19170388

(51) Int. Cl.
*A41D 1/084* (2018.01)
*A41D 31/28* (2019.01)

(52) U.S. Cl.
CPC ..... *A41D 31/28* (2019.02); *A41D 1/084* (2013.01)

(58) Field of Classification Search
CPC ..... A41D 13/015; A41D 1/084
See application file for complete search history.

(56) References Cited

U.S. PATENT DOCUMENTS 8,042,197 B2 * 10/2011 Maier ..... A41D 1/084 2/228
9,687,723 B2 * 6/2017 Maier ..... A41H 43/00
2005/0223478 A1 * 10/2005 Hogan ..... A41D 1/084 2/466

FOREIGN PATENT DOCUMENTS

EP 0776615 A2 6/1997
EP 2055202 A1 5/2009
EP 2740374 A1 6/2014
EP 2810574 A1 12/2014

OTHER PUBLICATIONS

Extended European Search Report in European Application No. 19170388.3.

* cited by examiner

*Primary Examiner* — Katherine M Moran
(74) *Attorney, Agent, or Firm* — Fox Rothschild LLP

(57) ABSTRACT

A seat pad (10) for a cycling garment designed for the male comprising a cover and two cushioning pads, each of said cushioning pads (12, 13) having a rear lobe (121, 131) and a front lobe (122, 132) and fixed to the cover by a perimeter attachment and also by an additional line of connection (124, 134) attaching the centre of the front lobe (122, 132) to the cover.

9 Claims, 3 Drawing Sheets

SEAT PAD FOR A CYCLIST GARMENT

FIELD OF APPLICATION

The present invention relates to cycling garments and particularly to a seat pad of a cycling garment.

BACKGROUND ART

Most cycling garments include a seat pad in the crotch area. The basic task of a seat pad is to dampen the contact of the ischiatic region with the saddle.

Seat pads are produced in a variety of shapes. For example, the seat pad can be specifically designed for road biking, mountain biking, etc. as well as for the male or female anatomy. In general terms, however, a seat pad includes a base panel, also termed cover, and one or more cushioning pads made of a suitable soft material, for example a foam material.

The cover may include one or more fabric layers. The cushioning pads may include one or more pads of a different shape, thickness or density, to provide a differentiated support on various zones of the saddle.

Multiple cushioning pads are generally arranged in a symmetrical pattern around a longitudinal line of symmetry of the seat pad. The cushioning pads may be fixed to the cover by stitching, hot sealing, gluing or another technique.

For example a known seat pad for a cycling garment which is particularly adapted for the male anatomy includes a cover and two cushioning pads located in the centre-rear portion of the seat pad. Each cushioning pad has a shape including basically a rear lobe located in the rear portion of the seat pad and a front lobe located in the central portion of the seat pad. The rear lobe is normally rounded and wider than the front lobe, whilst the front lobe has a slimmer and more elongate shape.

Each cushioning pad is fixed perimetrally to the cover. The fixation of a cushioning pad to the cover is usually made with a continuous line of attachment (for example by stitching) following the contour of the cushioning pad. However the fixation may also be discontinuous, for example made at discrete points.

Seat pads are normally assembled by thermoforming or stitching. The thermoforming technique provides that several parts are hot formed in a press to obtain the seat pad; being less expensive than manual stitching, it is normally applied to low- or mid-price items. Stitching is however preferred in hi-end items designed for the highest performance.

Among others, US 2010/0095432 discloses a seat pad for a cyclist garment.

The size and shape of the cushioning pads is selected to provide a support which is precisely located where desired, taking into account the anatomy of the user. The seat pad and the cushioning pads may be specifically designed for a male or a female user taking into account their different anatomy. A careful design of the cushioning pads can made the seat pad light and flexible providing the cushioning effect only when it is actually required when riding.

There is however a continuous effort to improve the performance of cycling garments and the aim of the present invention is to improve further the technique of seat pads of cycling garments.

SUMMARY OF THE INVENTION

The present invention aims to obtain a further improvement of the performance of the seat pad of a cyclist garment, particularly of its ability to conform to the pedalling action when riding. More specifically, the invention aims at a seat pad specifically designed for the male anatomy.

The above aims are reached with a seat pad according to claim 1.

The seat pad comprises a cover, which provides a base layer or base panel of the seat pad, and two cushioning pads. Said cushioning pads are arranged symmetrically relative to a median longitudinal axis of the seat pad and extend in the centre-rear portion of the seat pad.

Each cushioning pad has a rear lobe located in the rear portion of the seat pad and a front lobe located in the central portion of the seat pad. The rear lobe is preferably wider than the front lobe in a transverse direction, e.g. perpendicular to the above mentioned longitudinal axis.

Each cushioning pad is fixed to the cover by a perimeter attachment. Said perimeter attachment may be continuous or discontinuous. A continuous attachment can include an attachment line (e.g. a stitching line) while a discontinuous attachment can include a plurality of discrete attachment points or regions.

In addition to said perimeter attachment, each cushioning pad has another attachment to the cover which is strategically located in the front lobe. Said additional attachment is in the form of a linear attachment between the front lobe and the cover.

An advantage of said additional attachment is a more uniform thickness of the seat pad. The thickness of the seat pad denotes the thickness of the assembly including the cover and the two cushioning pads. The thickness of the seat pad is adjusted and equalized in the region of the front lobe thanks to the additional line of attachment. In the region of the front lobes of the seat pad, which is crucial for comfort of a male user, the front lobe attachment ensures a precise and constant thickness and compensates for slight variations which may be due to tolerance and/or to hand assembly. In some cases, the thickness may be reduced by the front lobe attachment.

Preferably, for each cushioning pad, said front lobe linear attachment is located in the centre of the front lobe.

Said front lobe linear attachment is preferably a continuous line, more preferably a continuous and straight line. It can be made by stitching or gluing or another technique suitable for fixation of the pads, or portion thereof, to the cover. The preferred technique is stitching.

In a preferred embodiment, the front lobe linear attachments are inclined relative to the longitudinal axis of the seat pad and they converge towards the front of the seat pad. The angle of inclination of said linear attachments, relative to said longitudinal axis, is preferably 10° to 40° and more preferably 20° to 30°. The front lobes of the cushioning pads may also be inclined and converge towards the front of the seat pad.

The cover may include one or more layers. In a preferred embodiment, each front lobe linear attachment connects the respective front lobe of the seat pad with all layers of the cover. More preferably each front lobe linear attachment is performed with a stitching which passes through all layers of the cover.

In some embodiments the cover of the seat pad includes at least one fabric layer and a layer of a soft material such as open-cell foam material. For example in a particularly preferred embodiment the cover of the seat pad includes a layer of a soft material sandwiched between two fabric layers. In another embodiment, the cover of the seat pad can be thermoformed.

The cushioning pads can be made of a foam material, preferably an open-cell foam material.

The seat pad may include additional cushioning pads. In an embodiment, however, the above mentioned cushioning pads are the only cushioning pads of the seat pad. In an embodiment, the seat pad has no other cushioning pad.

An aspect of the invention is also a cycling garment for a male user, including a seat pad according to the attached claims. It shall be noted that the front lobe linear attachments do not extend through the layer(s) of the cycling garment to which the seat pad is connected. For example they do not extend through fabric panels of the garment. The cycling garment can be, for example, a pair of cycling trousers, a bib or a suit.

The advantage of the invention is a surprising gain in the ability to conform to the male anatomy under intense action. The applicant has found the addition of the front lobe attachments increases the riding comfort and performance of male users in an unexpected way.

It is believed that the above advantage is due to an increased stability of the cushioning pads in the region of the front lobes, which correspond to a crucial zone (ischiatic/prostatic zone) for the comfort of a male rider. Also, the additional front lobe attachments make the seat pad more stable in the transverse direction, to the advantage of the precision of the cushioning effect, without affecting the elasticity in the longitudinal direction which is responsible for a proper following of the pedalling action.

The invention is particularly advantageous in the handcrafted cycling garments where it compensates for non-uniformities (e.g. a local small variation of thickness) of handmade items. Accordingly, the invention is particularly advantageous for hi-end cycling garments which are typically handmade.

It has to be noted the seat pad can be planar or modelled with an appropriate shape, e.g. a saddle-like curved shape. Accordingly said median line can be a straight line, i.e. a straight longitudinal axis, or a curvilinear line following a curvature of the seat pad, for example of the cover.

The attachment of the seat pad to the garment can be made with a known technique. For example, the seat pad can be attached to the garment along a front portion and rear portion, leaving a free central bridge portion, according to the teaching of EP 2 494 878 which is a patented technology of the applicant.

The feature and the advantages of the invention will be elucidated with the help of the following description of a preferred embodiment and with reference to the attached drawings.

DESCRIPTION OF PREFERRED EMBODIMENTS

Figure 1:
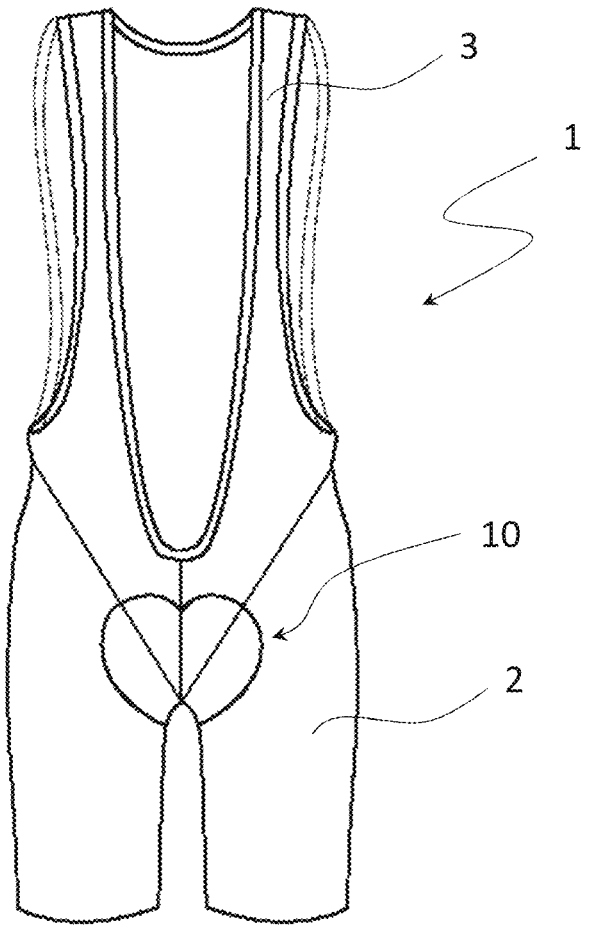
FIG. 1 illustrates a cycling bib with a seat pad.

FIG. 1 illustrates a cycling bib 1 including a seat pad 10 in the crotch area. The cycling bib 10 includes a pair of shorts 2 and suspenders 3. The shorts 2 are made of various fabric panels, connected together. The seat pad 10 is located in the crotch area of the shorts 2.

Figure 2:
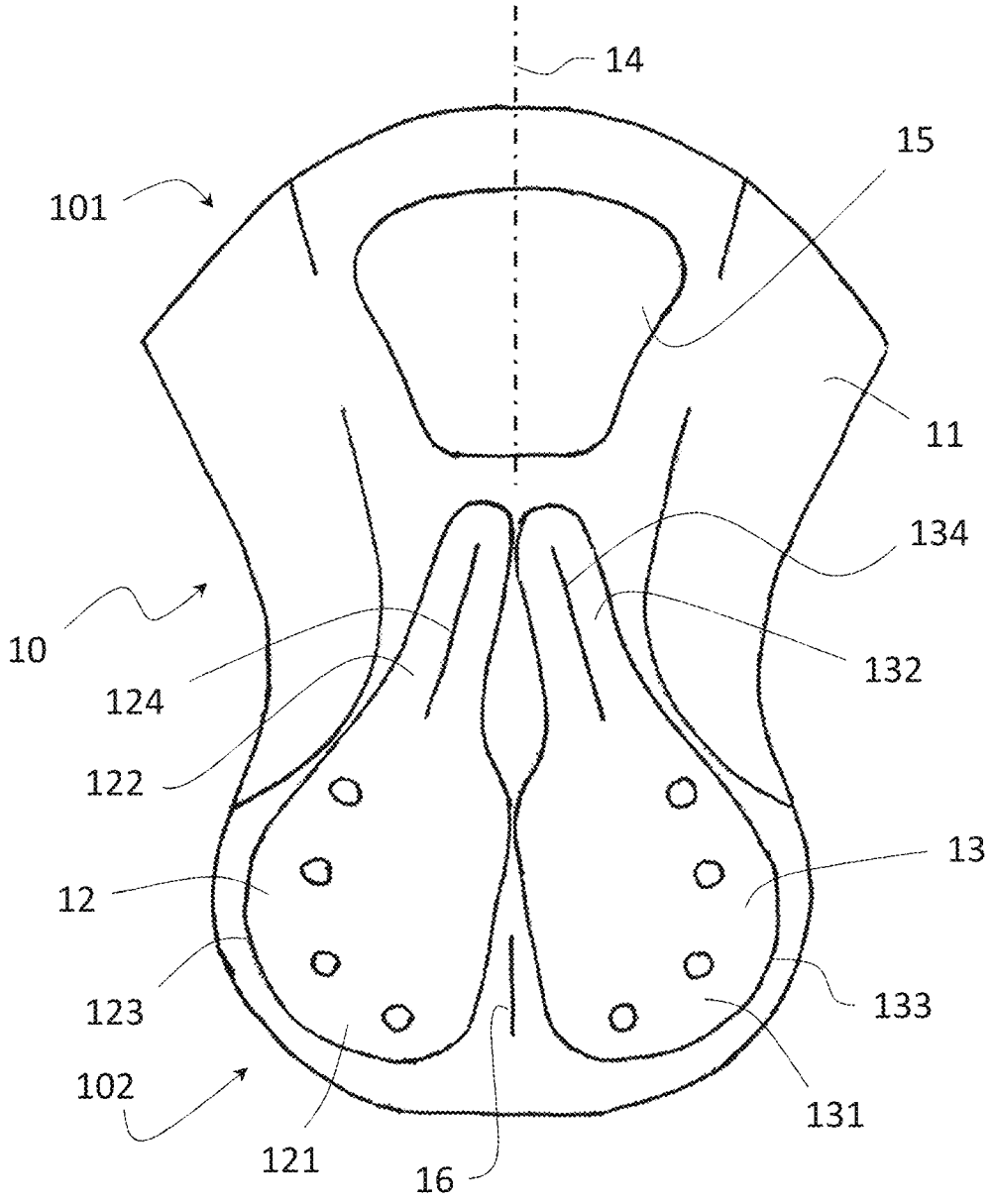
FIG. 2 is a top view of the seat pad of the bib of FIG. 1, according to an embodiment of the invention.

The structure of the seat pad 10 is described with the help of FIG. 2. The seat pad 10 includes a cover 11 with a left cushioning pad 12 and a right cushioning pad 13. The cushioning pads 12, 13 are arranged symmetrically relative to a median longitudinal axis 14 of the seat pad 10.

The seat pad 10 has a front region 101 and a rear region 102. The cushioning pads 12, 13 are located substantially in the centre-rear portion of the seat pad 10.

Each of said cushioning pads 12, 13 includes a rear lobe 121, 131 located in the rear portion of the seat pad 10 and a front lobe 122, 132 located in the central portion of the seat pad 10. The rear lobes 121, 131 have a rounded shape whilst the front lobes 122, 132 have a slim, elongated shape.

Each cushioning pad 12, 13 is fixed to the cover 11 by a perimeter stitching which follows the contour of the pad. Therefore a stitching line 123 or 133 forms a contour attachment of the cushioning pad 12 or 13 to the cover 11. In addition, each cushioning pad 12, 13 is also attached to the cover 11 by means of a stitching 124, 134 located in the front lobe. The stitching 124 or 134 constitutes a front lobe attachment of the cushioning pad 12 or 13, in addition to the perimeter attachment described above.

The FIG. 2 illustrates a preferred embodiment wherein the front lobe stitching line 124, 134 is located in the centre or about in the centre of the front lobe 122, 132. Each front lobe stitching line is a continuous and straight line which is inclined relative to the longitudinal axis 14. As a result of this, the stitching lines 124, 134 converge towards the front region 101 of the seat pad 10. In the shown embodiment, also the front lobes 122 and 132 converge in a similar manner towards the front of the seat pad 10. An angle of inclination of the stitching lines 124, 134 relative to said axis 14 is preferably 30° or around 30°.

The cover 11 may comprises a single layer or two or more superimposed layers.

Figure 3:
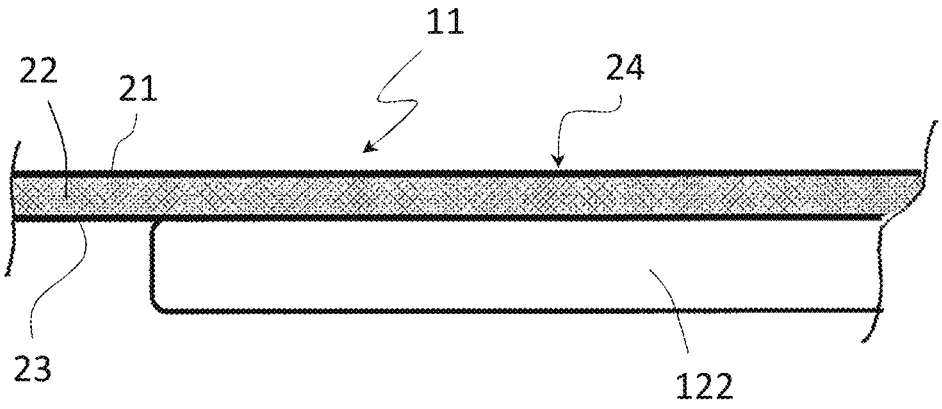
FIG. 3 is a schematic cross section of the seat pad of FIG. 2 in a vertical plane containing the axis.

FIG. 3 illustrates an exemplary cross section of the seat pad 10 showing the multilayer structure of the cover 11. The cover 11 includes an inner layer 21, a centre layer 22, and an outer layer 23. The inner layer 21, in use, faces the body of the user and forms the inner surface 24. One or more of the layers 21, 22 and 23 may be perforated.

A cover 11 with multiple layers may have a single-layer portion for accommodation of the male genitals. FIG. 1 illustrates this embodiment where the seat pad 10 includes a single-layer front window 15.

The cover 11 is fixed to the inner side of the trousers 2 with a known technique. The cover 11 may be fixed perimetrally and with a further stitching line 16 between the rear lobes of the cushioning pads 12, 13, as shown in FIG. 2.

Back to FIG. 3, the inner layer 21 is made for example of a fabric suitable for direct contact with the skin (so called inner layer); the centre layer 22 can be made of an open cell foam material to provide also the cover itself with a certain cushioning feature; the outer layer 23 is another fabric layer. A suitable fabric for the layers is for example Elastane fibre.

Figure 4:
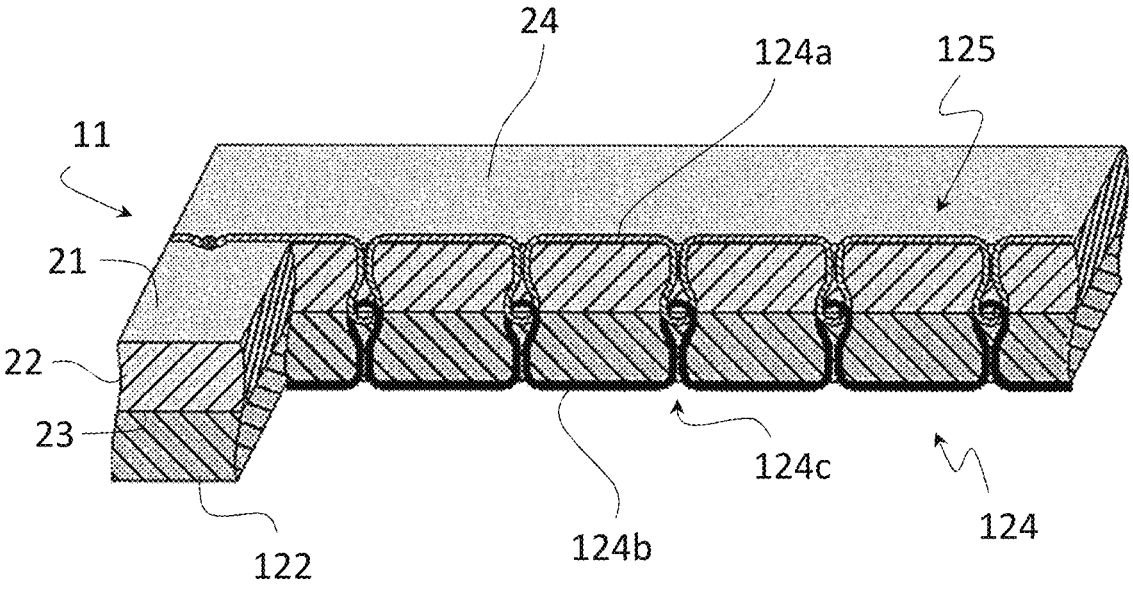
FIG. 4 is a schematic cross section of the seat pad in the region of the front lobes of the cushioning pads.

FIG. 4 is a cross section showing the stitching line 124 including a first thread 124*a* and a second thread 124*b* which form interconnected loops 124*c*.

FIG. 4 illustrates that the stitching 124 is performed through all the layers 21, 22 and 23 of the cover 11 and the cushioning pad 12. It can be appreciated that in the stitched region 125 around the stitching 124, the width of the assembly including the cover 11 and the cushioning pad 12 is adjusted by the tightening action of the threads 124*a*, 124*b* of the stitching 124.

The cushioning pad 12 is anchored to the cover 11 in a more stable manner without affecting the overall elasticity in the longitudinal direction of the axis 14. The stitching 124 does not intersect with panels of the garment 1, particularly of the trousers 2 (FIG. 1).

The stitching 134 of the other cushioning pad 13 can be made similar to FIG. 4.

The invention achieves the above mentioned purpose of delivering enhanced riding comfort and increased performance to male users.

The invention claimed is:

1. A seat pad for a cycling garment designed for the male anatomy wherein the seat pad comprises: a cover which provides a base layer of the seat pad; a left cushioning pad and a right cushioning pad; said cushioning pads are arranged symmetrically relative to a median longitudinal axis of the seat pad, and extend in a centre rear portion of the seat pad; each of said cushioning pads has a shape which includes a rear lobe located in a rear portion of the seat pad and a front lobe located in a central portion of the seat pad; each of said cushioning pads is fixed to the cover by a perimeter attachment made along the perimeter of the cushioning pad or a portion thereof and by an individual front lobe linear attachment which is located entirely in the front lobe of the cushioning pad, so that a first individual linear attachment connects the front lobe of the left cushioning pad to the cover, and a second individual linear attachment connects the front lobe of the right cushioning pad to the cover.

2. A seat pad according to claim 1, wherein the front lobe linear attachments are arranged to maintain a uniform thickness of an assembly including the cover and the cushioning pad.

3. A seat pad according to claim 1 wherein for each cushioning pad, said front lobe linear attachment is located in a centre of the front lobe of the cushioning pad.

4. A seat pad according to claim 1 wherein said front lobe linear attachment of each cushioning pad is a continuous and straight line of attachment.

5. A seat pad according to claim 1 wherein the front lobe linear attachments are inclined relative to the longitudinal axis and converge towards the front of the seat pad.

6. A seat pad according to claim 1, wherein the front lobe linear attachments are made by stitching.

7. A seat pad according to claim 6 wherein the cover includes one or more layers and each front lobe linear attachment is made by a stitching which is performed through the respective front lobe of the cushioning pad and through all layers of the one or more layers of the cover.

8. A seat pad according to claim 1 wherein the front lobe linear attachments are made by gluing or another technique.

9. A cycling garment (1) for a male user, including the seat pad according to claim 1.

* * * * *